US006378763B1

(12) United States Patent
Nelson et al.

(10) Patent No.: US 6,378,763 B1
(45) Date of Patent: Apr. 30, 2002

(54) WINDOW FOR SPIRALLY FORMED CONTAINERS

(75) Inventors: Brian E. Nelson, Camden; James L. Lowry, Florence, both of SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/326,346

(22) Filed: Jun. 4, 1999

(51) Int. Cl.[7] ..... B65D 3/28
(52) U.S. Cl. ..... 229/162; 229/4.5
(58) Field of Search ..... 229/4.5, 162, 400; 206/769

(56) References Cited

U.S. PATENT DOCUMENTS

| | | | | |
|---|---|---|---|---|
| 1,463,437 A | | 7/1923 | Oliver | |
| 1,487,629 A | | 3/1924 | Wainwright, Jr. | |
| 1,520,870 A | | 12/1924 | Koch | |
| 1,632,187 A | | 6/1927 | Koch | |
| 1,685,494 A | | 9/1928 | Koch | |
| 1,894,295 A | | 1/1933 | Scandore | |
| 1,992,182 A | * | 2/1935 | Buist | 229/4.5 |
| 2,172,864 A | | 9/1939 | Calva et al. | |
| 2,226,340 A | * | 12/1940 | Flood | 229/162 |
| 2,275,542 A | * | 3/1942 | Menges | 229/4.5 |
| 3,490,678 A | * | 1/1970 | James et al. | 229/162 |
| 3,690,523 A | * | 9/1972 | Link | 229/162 |
| 3,977,309 A | | 8/1976 | Gilbert | |
| 3,991,663 A | | 11/1976 | Glasby | |
| 4,256,027 A | | 3/1981 | Strohband | |
| 4,664,648 A | * | 5/1987 | Dupuy | 229/162 |
| 4,696,840 A | * | 9/1987 | McCullough et al. | 229/162 |
| 4,854,474 A | * | 8/1989 | Murray et al. | 229/162 |
| 5,012,972 A | | 5/1991 | Nordstrom et al. | |
| 5,197,625 A | * | 3/1993 | Mullaney | 229/162 |
| 5,829,669 A | | 11/1998 | Drummond et al. | |
| 5,846,619 A | | 12/1998 | Cahill et al. | |
| 6,033,114 A | * | 3/2000 | Grimm et al. | 383/106 |

FOREIGN PATENT DOCUMENTS

| | | | |
|---|---|---|---|
| DE | 3920484 | * 1/1991 | 229/162 |
| GB | 2 074 124 | 10/1981 | |
| JP | H2-76729 | 3/1990 | |
| JP | 04310739 | 11/1992 | |

OTHER PUBLICATIONS

Abstract –vol. 014, No. 266 (M–0982), Jun. 8, 1990; XS 0030464110 MA.

Abstract –JP O2076729 A; Showa Prod KK; Mar. 16, 1990; "Manufacture of Container Cylinder with See–Through Window".

* cited by examiner

*Primary Examiner*—Gary E. Elkins
(74) *Attorney, Agent, or Firm*—Alston & Bird LLP

(57) ABSTRACT

A container having a window for viewing the product contained therein and an associated method of manufacture is provided. The container is constructed of at least one body ply and a liner ply. The body ply defines at least one aperture therethrough such that when the body ply is wrapped into a tubular shape the aperture forms a window through the body ply into the container. The liner ply extends across the aperture in the body ply and has a sufficiently low opacity that allows the product in the container to be viewed through the window. The liner ply provides a moisture and gas barrier inside the container around the product. The container may include a label ply. The label ply defines at least one aperture therethrough. The cutting of the at least one aperture in the label ply is registered. The body ply defines at least one aperture therethrough corresponding to the at least one aperture in the label ply. The body ply is wrapped around the previously wrapped liner ply on the mandrel and then the label ply is wrapped around the previously wrapped body ply and liner ply so that the apertures in the label ply are aligned with apertures in the body ply to create a tubular shape having a viewing window through both body plies.

34 Claims, 2 Drawing Sheets

WINDOW FOR SPIRALLY FORMED CONTAINERS

FIELD OF THE INVENTION

The present invention relates to tubular product containers and methods and apparatus for making containers and, more particularly, relates to tubular containers having a window for viewing the product contained therein.

BACKGROUND OF THE INVENTION

Food and drink products and other perishable items are often packaged in tubular composite containers that are sealed at both ends. Conventional tubular composite containers typically include at least one structural body ply and are formed by wrapping a continuous strip of body ply material around a mandrel of a desired shape to create a tubular structure. The body ply strip may be spirally wound around the mandrel or passed through a series of forming elements so as to be wrapped in a convolute shape around the mandrel. At the downstream end of the mandrel, the tube is cut into discrete lengths and is then fitted with end caps to form the container.

To assist consumers in making purchasing decisions, it is desirable to provide a composite container for products constructed with one or more openings or windows in the container wall to enable the consumer to view the product stored therein. An opening or window into the container not only provides the consumer with the ability to compare the appearance of competing products, but also provides the consumer with confidence that the product does not have any defects, such as food spoilage in the case of food products, prior to making a purchase.

One example of a tubular container having a window for viewing the container contents from outside the container is disclosed in U.S. Pat. No. 1,894,295 to Scandore, which discloses a method of constructing a container having a window covered with a transparent material, such as cellophane. The container is constructed by spirally wrapping an inner ply of cardboard and cutting openings therethrough to provide sight openings. A transparent material, such as cellophane, is partially wound over or otherwise positioned on the exterior of the inner ply so as to cover the sight openings. An outer layer of cardboard having openings cut therein to coincide with the openings in the inner ply is then wrapped over both the inner ply and the transparent material in a direction opposite to the direction of wrap of the inner ply. A decorated outer wrapper having openings corresponding with the sight openings may be applied to the outer ply.

However, the composite container disclosed in the '295 patent is not particularly suited for storing food products, especially those which have a liquid component. The transparent material does not provide an adequate moisture or gas barrier to seal the container and protect any stored food product from contamination or spoilage or to prevent wicking or leakage of the food product into and through the container wall. More generally, aligning the sight openings cut in the consecutive plies of material when wrapping the plies around the mandrel to form a container also creates many manufacturing difficulties, especially where the constituent plies of material are wrapped at relatively high speeds, for example 400 feet per minute. Variations in ply speed and splices in the ply material can cause misalignment of the sight openings, resulting in excessive material waste due to the discarding of defective containers.

Typically, tubular composite containers for storing food products include a liner ply on the inner surface of the paperboard body ply. The liner ply prevents liquids such as juice from leaking out of the container and also prevents liquids from entering the container and possibly contaminating the food product stored therein. Preferably, the liner ply is also resistant to the passage of gasses, so as to prevent odors of the food product in the container from escaping and to prevent atmospheric air from entering the container and spoiling the food product. Thus, the liner ply provides barrier properties and the body ply provides structural properties. Conventional liner plies most often include aluminum foil, which has good barrier properties and also has advantageous strength properties. In particular, the liner is wound onto the mandrel prior to the winding of the body ply and must be sufficiently strong and stiff to be independently wound on the mandrel without stretching or wrinkling. Because of the support provided by the foil layer of the liner, such liners are known as "supported" liners. One or more polymeric layers are normally adhered to the foil to further improve the barrier properties of the liner and it is sometimes the case that the foil layer is not necessary for barrier properties, but is included in the liner only to provide support.

However, foils are nontransparent and thus, are not suitable for covering a sight opening through the container wall. It is therefore desired to provide a container and a method of making such a container that includes a liner of sufficiently low opacity to allow viewing of the stored product from outside the container, but that provides both moisture and gas barriers to prevent contamination and spoilage of stored food product and to prevent wicking and leakage of the food product into and through the container wall. Because such a liner would necessarily not include a foil layer, the liner would be an "unsupported" liner.

The use of unsupported liners presents many technical challenges. For example, because of the problems associated with winding an unsupported liner on the mandrel, such as stretching, creasing or other misshaping of the liner, it has not been commercially feasible with conventional winding apparatus and methods to manufacture a container having an unsupported liner ply. The assignee of the present application and others in the field have striven toward developing practicable methods and apparatus for making containers with such unsupported film liners. For example, the assignee of the present application has developed methods and apparatus for making composite containers with unsupported liners made of polymer film, as disclosed in commonly owned U.S. Pat. No. 5,846,619 entitled "Polymeric Liner Ply for Tubular Containers and Methods and Apparatus for Manufacturing Same" issued Dec. 8, 1998, and U.S. Pat. No. 5,829,669 entitled "Tubular Container and Methods and Apparatus for Manufacturing Same" issued Nov. 3, 1998, the entire disclosures of which are hereby incorporated herein by reference.

In light of the foregoing, there is need for an improved container and method of making the same having a window through the container wall. Such a container should include a liner providing both a moisture and optionally a gas barrier to prevent contamination and spoilage of stored food product and to prevent wicking and leakage of the food product into and through the container wall and at the same time allow viewing of the product. In addition, the improved container must be capable of being manufactured efficiently and inexpensively, and in particular, be capable of being efficiently constructed by wrapping the constituent plies at relatively high speeds while maintaining accurate alignment of the sight openings provided in the material plies.

SUMMARY OF THE INVENTION

The present invention provides a multi-ply tubular container having a window for viewing the product contained therein. The window is advantageously formed in a paperboard body ply and covered by a transparent polymeric liner ply on the inner surface thereof. In this manner, the product can be viewed through the window and is also sealed from leaking out of the container. More particular, the container is constructed of at least one body ply formed of a fibrous paperboard. The body ply is wrapped into a tubular shape having an inner surface and an outer surface. The body ply defines at least one aperture therethrough such that when the body ply is wrapped into a tubular shape the aperture forms a window into the container. The liner ply is adhered to the inner surface of the body ply such that a portion of the liner ply extends across the aperture in the body ply. The liner ply can be adhered to the inner surface of the body ply with a wet adhesive or a polymeric adhesive. The tubular container may further include a label ply adhered to the outer surface of the body ply and defining at least one aperture therethrough corresponding to the aperture in the body ply. The body ply and liner ply can be either helically or longitudinally wound.

Advantageously, the liner ply can be a polymeric material having a low opacity that allows the product in the container to be viewed through the window. In one embodiment, the liner ply can be substantially transparent. The liner ply may include a polymeric moisture barrier layer, such as a polyolefin polymer. In other embodiments, the moisture barrier layer may include at least one of the group of polyester, nylon, ethylene vinyl alcohol copolymer and blends thereof. In a preferred embodiment, the liner ply has a thickness of less than about three mils.

The present invention also provides an associated method of manufacturing multi-ply tubular containers having a window for viewing the product contained therein. The method includes the steps of advancing a continuous polymeric liner ply towards and wrapping the liner ply around a shaping mandrel to create a tubular shape. Advantageously, the liner ply is comprised of a polymeric material having a low opacity such that the product in the container can be viewed through the liner ply. A continuous body ply formed of paperboard is also advanced towards the mandrel. Apertures are cut in the body ply at predetermined intervals along its length. The body ply is wrapped around the previously wrapped liner ply on the mandrel so that the liner ply becomes adhered to the body ply to create a tubular shape having a viewing window sealed by the liner ply. Once constructed, the tubular shape is cut into discrete lengths adjacent the end of the mandrel. At least one end of each tube length can then be rolled outwardly to form a bead or flange for metal end. Preferably, the liner ply is elastically deformable to prevent the bead from unrolling.

In another embodiment, a continuous polymeric liner ply is advanced towards and wrapped around a shaping mandrel to create a tubular shape. The liner ply is preferably comprised of a polymeric material having a low opacity such that the product in the container can be viewed through the liner ply. A body ply and a label ply are advanced towards the shaping mandrel. Apertures are cut through the label ply at predetermined intervals along the length of the label ply. The location of the apertures in the label ply are registered. Apertures are cut through the body ply at predetermined intervals along the length of the body ply corresponding to the apertures cut in the label ply. The body ply is wrapped around the previously wrapped liner ply on the mandrel. The label ply is wrapped around the previously wrapped body ply and liner ply so that the apertures in the label ply are aligned with apertures in the body ply to create a tubular shape having a viewing window through both the label and body plies.

Accordingly, there has been provided a tubular container having a window through the container wall sealed by a transparent polymeric liner ply for viewing the product stored therein from outside the container. Advantageously, the liner provides a moisture and gas barrier to protect any stored food product from contamination and spoilage and to prevent wicking and leakage of the food product into and through the container wall. There has also been provided an associated method of efficiently and inexpensively manufacturing a tubular container having a window through the container wall for viewing the product stored therein; the container being efficiently constructed by wrapping the constituent plies at relatively high speeds while maintaining accurate alignment of the sight openings provided in the plies of material.

BRIEF DESCRIPTION OF THE DRAWINGS

Some of the objects and advantages of the present invention having been stated, others will appear as the description proceeds when taken in conjunction with the accompanying drawings, which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
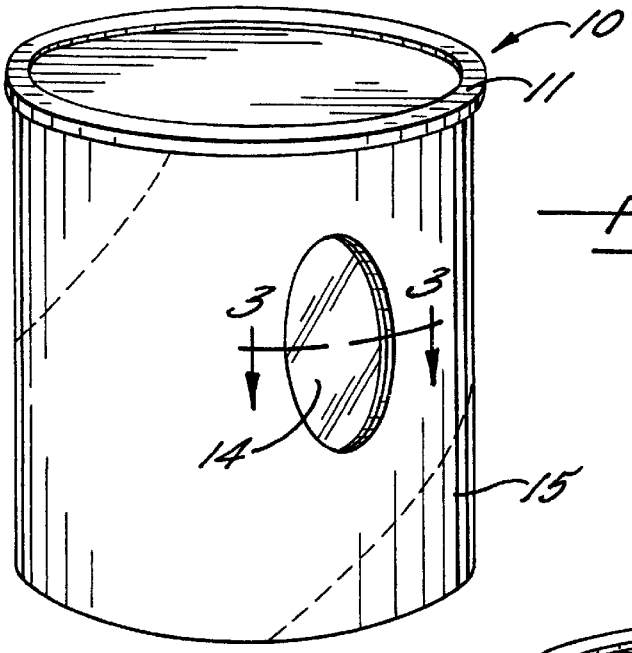
FIG. 1 is a perspective view illustrating a tubular container having a viewing window constructed according to the present invention.

A tubular container 10 according to the present invention is illustrated in FIG. 1. Although illustrated as having a circular cross section, the tube may have any cross sectional shape that can be formed by wrapping the tube around an appropriately shaped mandrel. One example is a generally rectangular shaped tube having rounded corners. The embodiment illustrated in FIG. 1 is particularly advantageous for packaging potato crisps and may include a flexible membrane seal (not shown) and a reusable plastic end cap 11 over the seal. Various other end closures may be used, however, depending upon the type of food or beverage product which is to be packaged. For example, where dough is to be packaged, the end caps are typically constructed of metal and are crimp-sealed onto the ends of the container.

Figure 2:
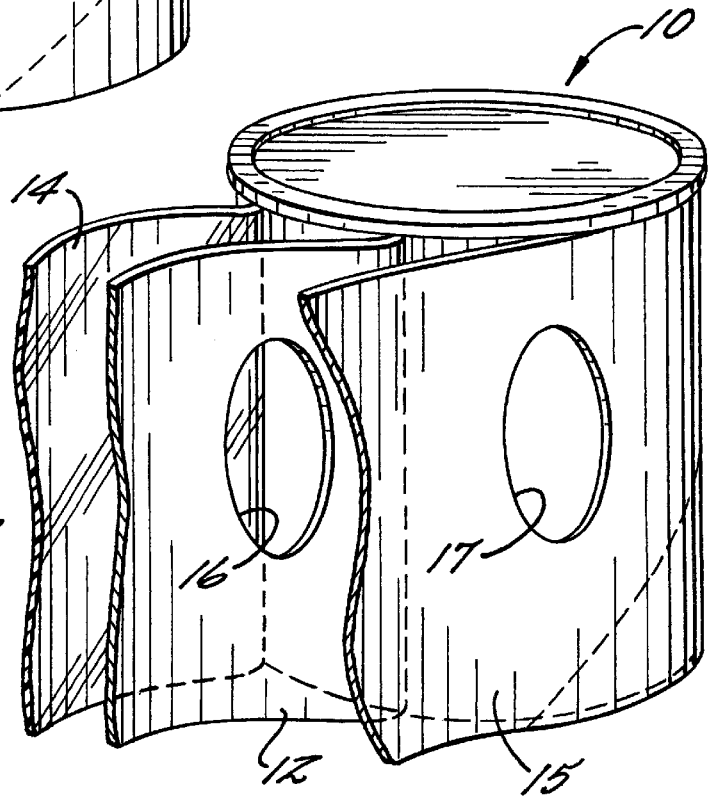
FIG. 2 is a partially exploded perspective view illustrating the constituent plies of the tubular container of FIG. 1.
Figure 3:
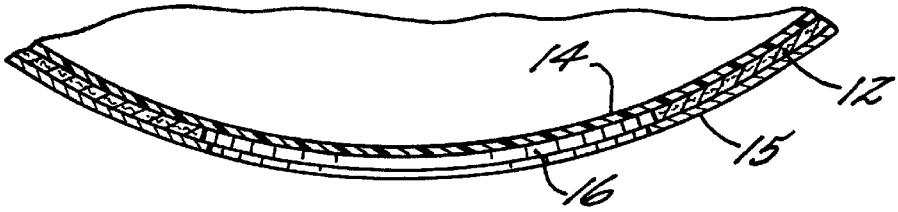
FIG. 3 is a fragmentary and enlarged sectional view illustrating an end of the tubular container having a viewing window taken along lines 3—3 of FIG. 1.

As illustrated in more detail in FIGS. 2 and 3, the tubular container 10 includes a wall having a body ply 12, which is preferably formed of paperboard, a liner ply 14, which is preferably formed of a polymeric material adhered to the inner surface of the body ply, and a label ply 15, which may have various indicia printed thereon regarding the product within the container. The upper end of the tubular container can be rolled over so as to form either a bead (not shown) or flange for metal end or closure. An end cap 11 can be snapped over the bead and may be reused. A metal closure (not shown) can be secured to the opposite end of the container or to both ends.

Figures 4, 5:
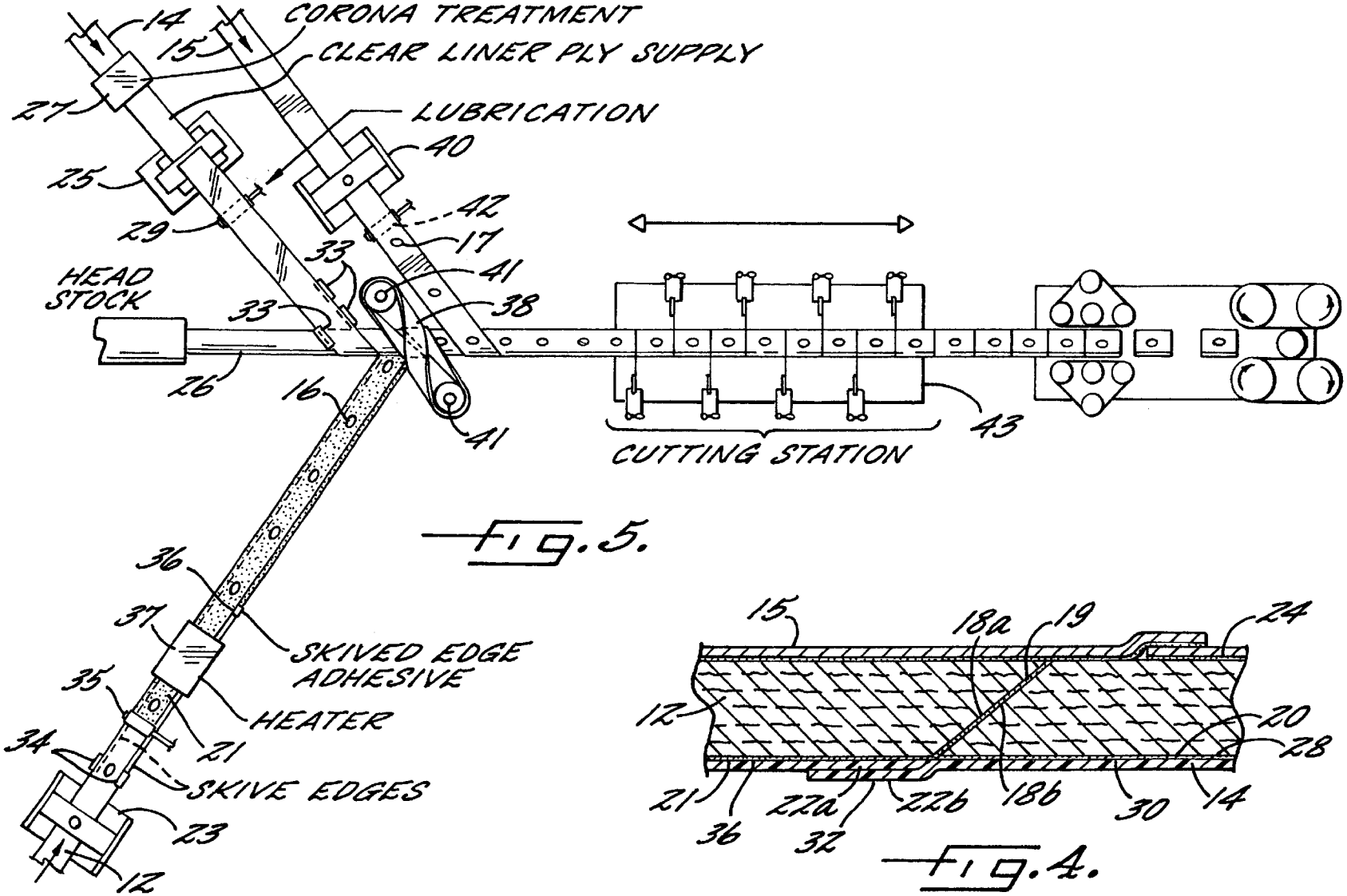
FIG. 4 is an enlarged sectional view illustrating the polymeric liner ply, paperboard body ply and a label ply of a container constructed according to the present invention.
FIG. 5 is a plan view of an apparatus according to the present invention for making a tubular container.

The seams where the various plies are joined together are illustrated in FIG. 4. The paperboard body ply 12 is made of a relatively thick and stiff paperboard. The body ply has an aperture 16 cut therethrough, as illustrated in FIGS. 2 and 3. The edges 18*a,b* of the body ply are first skived and then joined together during the tube forming process with an adhesive 19 to create a strong seam. The liner ply 14 is adhered to the inner surface 20 of the body ply with a wet or a polymeric adhesive 21. The edges 22*a,b* of the liner ply are adhered together, in overlapping relationship to ensure that the container 10 is completely sealed. A label ply 15 is preferably adhered to the outer surface 24 of the body ply. The label ply has an aperture 17 cut therethrough corresponding to the aperture 16 cut in the body ply.

An apparatus for constructing tubular containers with viewing windows according to present invention is illustrated in FIG. 5. A continuous strip of liner ply material 14 is fed from a reel (not shown) to the apparatus. The liner first passes through a tension control device 25 on its way to being wrapped about the mandrel 26. Various types of devices may be used for controlling the liner tension, as are known in the art. Regardless of the specific device chosen for controlling liner tension, advantageously the tension control device is capable of maintaining the liner tension at less than about 1 pound per inch of width of the liner, and more preferably less than about 0.5 pound per inch of width. For instance, for a liner having a width of 7 inches, the tension control device should maintain the liner tension at about 2–3 pounds.

After the tension control device 25, the liner 14 passes through a surface treatment unit 27 that treats the outer surface 28 of the liner (i.e., the surface which will face outward away from the mandrel 26 and be adhered to the inner surface 20 of the paperboard body strip 12) to improve wetting and adhesion of adhesive thereto. The surface treatment unit in a preferred embodiment of the invention comprises a corona discharge unit. However, other devices such as flame treatment devices may be used instead. After passing through the surface treatment unit, the liner passes through an optional lubrication device 29 that applies a lubricant to the inner surface 30 of the liner (i.e., the surface which contacts the mandrel) for aiding in movement of the liner along the mandrel. In some applications, the lubricant may not be needed and thus the lubrication device can be omitted. For example, where the liner has an inner surface formed of a material with a melting temperature substantially higher than the mandrel temperature, scuffing of the liner on the mandrel may not be a significant problem and hence the lubricant may not be required.

A preferred liner construction includes a seal layer, a moisture-barrier layer, and an adhesive layer. The liner is preferably transparent, a the portions which will cover the windows in the container, although translucent and slightly opaque liner materials could be used which allow some visibility of the product packaged therein. The barrier layer may be resistant to the passage of liquids and gasses such as oxygen. If a barrier is required for both liquids and gasses, a preferred barrier material is polyester. Some food products, however, do not require a gas barrier, such as various juices, and other barrier materials may be used (although the barrier may also be generally resistant to the passage of gasses). It will be understood that various barrier materials or properties could be employed depending upon the item being packaged. Alternative barrier materials include nylon, EVOH (ethylene vinyl alcohol polymer and copolymer), polyvinylidene chloride, polyethylene, polypropylene, and silicon dioxide coated polymers and the like, as will be apparent to the skilled artisan. The liner ply 14 preferably has a total thickness less than about 3 mils, and more preferably, a total thickness closer to 1 mil.

After passing through the lubricating device 29, the marginal edge portions 22*a,b* of the liner ply 14 are passed over or under one or more infrared heaters and/or forced air heaters 33, which heat the marginal edge portions of the liner ply. An infrared heater capable of generating a heat flux of at least about 83,000 $W/m^2$ has been determined to be sufficient. The liner ply is then helically wrapped about the mandrel 26 such that one marginal edge portion 22*b* of the liner overlaps an opposite marginal edge portion 22*a* of a previously wrapped helical turn of the liner to form a sealed straight lap seam 32 therebetween, as illustrated in FIG. 4. The overlap joint is sealed by heating the liner to raise the temperature of the liner to at least the sealing temperature of the adhesive layer that defines the radially outer surface of the liner. The adhesive layer includes a non-aqueous polymeric adhesive that is activated at a predetermined sealing temperature. Such adhesives, which are also known as "dry-bond" adhesives, can include one or more of the following polymers or modified copolymers thereof: ethylene vinyl acetate, ethylene acrylic acid, ethylene methacrylic acid, ethylene methyl acrylate and blends with each other or lower cost polyolefins. A preferred embodiment includes an adhesive layer having two sublayers that are coextruded together. The inner sublayer is preferably ethylene acrylic acid, which adheres well to the polyester barrier layer of the liner, and the outer sublayer is preferably ethylene methyl acrylate, which adheres well to the paperboard body ply 12. The adhesive layer is manufactured as part of the liner ply. A liner ply 14 wherein the liner ply is adhered directly to the body ply is described in U.S. Pat. No. 5,846,619 issued Dec. 8, 1998, which is assigned to the assignee of the present invention and is incorporated herein by reference. Such a liner can be used to eliminate the step of applying a wet adhesive 21 to the body ply 12.

A seal layer may also form a part of the liner ply 14 and defines the radially inner surface 30 of the liner ply. The seal layer provides a surface against which the adhesive layer is adhered when the overlapping marginal edge portion 22*b* of the liner ply is brought into an overlapping relationship with the opposite marginal edge portion 22*a* of a previously wrapped helical turn of the liner. The seal layer may include a polyolefin polymer, which is preferably high-density polyethylene or a mixture of high-density polyethylene and low-density polyethylene. One advantageous feature of the seal layer is that it has a higher melting temperature than the adhesive layer. As noted above, the overlapping marginal edge portion 22*b* of the liner ply is raised to a temperature (whether heated before reaching the mandrel 26 or while on the mandrel) such that the adhesive layer is activated. However, if the seal layer was made of the same polymer as the adhesive layer or had a melting temperature equal to or less than the melting temperature of the adhesive layer, the seal layer would be melted and inclined to stick to the mandrel, which would greatly impede the winding process. The present invention does not suffer from this problem, however, because the seal layer has a melting temperature higher than the activation temperature of the adhesive layer.

Because the liner is very thin, it has very little capacity to retain heat. Accordingly, heating the liner prior to the liner being wrapped onto the mandrel 26 would be inefficient and difficult to accomplish in view of the rapid cooling which would take place subsequent to the heating device and prior to the liner being wrapped about the mandrel. Accordingly, the heating of the liner in accordance with a preferred embodiment of the present invention is performed in a two-stage process while the liner is on the mandrel such that the mandrel acts as a heat sink for efficiently heating the liner overlap joint. More particularly, a portion of the mandrel has a fluid passage (not shown) through which a heated fluid is circulated to elevate the temperature of the portion to below the sealing temperature of the adhesive layer of the liner. For instance, where the sealing temperature of the adhesive layer is about 180–220° F., the heated portion of the mandrel is heated to about 130–170° F. (i.e., about 50° F. below the sealing temperature of the adhesive layer). The liner passes over the heated mandrel portion as it is wrapped about the mandrel and thus is pre-heated to a temperature essentially equal to that of the mandrel portion. The overlapping edge portions 22*a,b* of the liner are then further heated to at least the sealing temperature of the adhesive layer by a pair of local heaters, specifically infrared heaters and/or forced-air heaters 33, which direct heat locally at the overlap joint of the liner. The infrared radiation penetrates through the overlapping edge portions 22*a,b* of the liner and locally heats a portion of the mandrel underlying the edge portions to a temperature at least as great as, and preferably somewhat higher than, the sealing temperature of the adhesive layer. This also heats the edge portions of the liner to a temperature such that the adhesive layer becomes capable of adhering to the seal layer. The infrared heaters and/or the forced-air heaters may be elongated in the helical direction.

After the liner ply 14 is wrapped about the mandrel 26, a first structural body ply 12 may be wrapped around the liner ply and adhesively secured thereto. A continuous strip of paperboard body ply material 12 is fed from a reel (not shown) to the apparatus and is first passed through a pair of opposed edge skivers 34. As illustrated in FIG. 4, the edge skivers remove part of the square edge of the body ply to create first and second edges 18*a,b* having a beveled configuration. The body ply is then advanced through a cutting die 23, which selectively cuts openings 16 through the body ply along the length of the body ply.

The body ply 12 is then advanced through an adhesive applicator 35, which applies an adhesive 21 to the inner surface 20 of the body ply, as illustrated in FIG. 5. The adhesive 21 is advantageously an aqueous adhesive that overcomes the many problems associated with solvent-based adhesives. No special equipment is needed to capture solvents that evaporate from the adhesive in order to comply with environmental regulations. One preferred adhesive is No. 72-4172, which is available from the National Starch and Chemical Company. Another adhesive that may be used is No. 33-4060, which is also available from the National Starch and Chemical Company. Alternatively, the application of adhesive 21 to the body ply may be dispensed with in the event the embodiment of the liner ply 14 having an adhesive layer across the entire width of the liner ply is utilized. In either case, the adhesive will advantageously not interfere with the transparency of the liner ply.

The body ply 12 and wet adhesive 21 applied thereto are then passed underneath a heater 37 that evaporates at least part of the water content of the aqueous adhesive 21 to render the adhesive substantially tacky. It is important that the correct amount of heat is supplied to the adhesive. Insufficient heat will not evaporate enough water in a sufficiently short period of time with the result that the adhesive will not be rendered sufficiently tacky. Conversely, too much heat will overdry the adhesive and cause the adhesive to lose tackiness. It has been discovered that at least about 100,000 J/m$^2$ is an appropriate amount of heat to render the wet adhesive tacky. More particularly, heating the adhesive with at least about 460,000 J/m$^2$ is preferred. It has been determined that, if the body ply is moving at a speed of about 50 feet per minute (or is heated for less than about 3 seconds), heating the adhesive 21 with a heater 37 having a heat flux of 200,000 W/m$^2$ will raise the temperature of the paperboard body ply to at least the boiling point of water (212° F. at sea level), and as high as 320° F. It will be understood by one of ordinary skill in the art, however, that these parameters may change depending on various factors including the efficiency of the heat source, the speed of the body ply (line speeds up to about 400 ft./min. are contemplated) and the type of adhesive used. Accordingly, a sufficient amount of heat is that which causes the adhesive to become tacky in a short period of time without being overdried. A preferred type of heat source is an infrared heater although various other heat sources, e.g., forced air heating or the like can be used.

One skived edge 18*a* of the body ply 12 is then passed under a skive adhesive applicator 36 that applies the skive adhesive 19 to the beveled surface of the skived edge of the body ply. The skive adhesive 19 is preferably a hot melt adhesive of the type that is conventional in the art although it could also be another polymeric-type adhesive. The skive adhesive helps provide a stronger body-ply bond, especially for single body-ply containers.

The body ply 12 is then wrapped around the shaping mandrel 26 over the previously wrapped liner ply 14. The body ply is first wrapped under the mandrel then back over the top in a helical fashion. The skived edges 18*a,b* become abutted together and the skive adhesive 19 adheres the edges together to form a spirally wound tube. The inner surface 20 of the body ply comes into contact with the outer surface 28 of the liner ply, which is exposed on the mandrel, and becomes adhered thereto to form a single tube either through the wet adhesive 21 applied to the body ply or alternatively, the adhesive layer formed integrally in the liner ply. Preferably, the seam formed by the skived first and second edges 18*a,b* of the body ply are spaced from the seam 32 formed by the overlapping first and second edge portions 22*a,b* of the liner ply 14. In one preferred embodiment, multiple contiguous structural body plies can be used. The tube is then advanced down the mandrel by a tube conveyor, such as a conventional winding belt 38, which extends around a pair of opposed pulleys 41. The winding belt not only rotates and advances the tube, but also applies pressure to the overlapping edges of the body ply 12 and liner ply 14 to ensure a secure bond between the respective ply edges.

In a preferred embodiment, a label ply 15 may then be attached to the outer surface 24 of the body ply 12. As illustrated in FIG. 5, a continuous strip of pre-printed label ply material is fed from a reel (not shown) to the apparatus. The label ply is advanced through a cutting die 40, which selectively cuts openings 17 through the label ply along the length of the label ply. Preferably, the label ply is printed with an optically or magnetically readable eye mark or other locating device. As the label ply approaches the die cutter 40, the locating device is registered by an encoder, which then provides a signal to the label rotary die 40 instructing the rotary die to make a cut. This allows the cut in the label ply to be formed in a desired spatial relationship to the decorative print pattern such that, for example, the window in the container can be "framed" by the printed pattern on the label.

At the same time, the signal from the encoder is communicated to a processing unit, which is also in electrical communication with the die cutter 23 for the body ply 12. The processing unit is programmed with the distance of each die cutter 23,41 from the mandrel 26. Additionally, sensors, which are preferably attached to the ply reel (not shown) for the body and label plies, measure the ply speeds for the body and label plies and communicate this information to the processing unit. The signal to the processing unit generated when the encoder reads the eye mark on the label ply 15 initializes the processing unit. The processing unit then computes the location of the cut to be made in the body ply based upon the distance of the die cutters 23,41 from the mandrel and the ply speeds of the body and label plies so that the apertures cut in the body and label plies align when the plies are wrapped about the mandrel.

Advantageously, the processing unit and die cutters are continuously updated with the ply speeds and the passing of the eye marks so that the openings in the body and label plies are consistently and accurately aligned. To accommodate any build up of tolerances, each subsequent aperture may be made slightly smaller so as to appear centered in the previously applied aperture. For example, the aperture 17 in the label ply 15 may be slightly smaller than the aperture 16 in the body ply 12. The diameter of each subsequent aperture is preferably smaller than the previous aperture by approximately 0.0625 in. In the event of a splice in the label ply 15, the apparatus of FIG. 5 will be able to reset itself within one container length of material after the splice has come through. The label ply is passed over an adhesive applicator 42. The label ply is then wrapped around the body ply 12. The label ply could be applied before the winding belt 38.

As previously mentioned, the method of constructing containers 10 with windows for viewing the stored product from outside the container according to the present invention is not limited to one or two body plies, but is also applicable to three or more body plies. Advantageously, the processing unit is programmed with the distance of each die cutter from the mandrel and is continuously updated with the respective ply speeds such that when the processing unit is initialized by the eye mark signal generated when the eye mark on the last ply is read by the encoder, the processing unit computes the location of the corresponding cuts in each ply and signals the respective die cutters when to cut thereby assuring consistent and accurate alignment of the apertures cut in each ply when the plies are wrapped about the mandrel.

At a cutting station 43, the continuous tube is cut into discrete lengths and removed from the mandrel 26. The ends of the containers 10 are then rolled outwardly to form the bead or a flange (not shown). Another advantageous feature of the polymeric liner ply according to the present invention is that the elasticity of the polymer causes the bead to be locked in place once rolled. Conventional inelastic foil liners may have a tendency to unroll the bead or crack, which can present a problem when sealing the ends of the container.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multi-ply tubular container having a window for viewing the product contained therein comprising:

at least one body ply formed of a fibrous paperboard, said body ply being wrapped into a tubular shape having an inner surface and an outer surface, said body ply defining at least one aperture therethrough such that said aperture forms a window into the container;

a liner ply adhered to the inner surface of said body ply and having a portion extending across said aperture, said liner ply comprised of a polymeric material having a low opacity which allows the product in the container to be viewed through the window; and a label ply adhered to the outer surface of said body ply and defining at least one aperture therethrough corresponding to said at least one aperture in said body ply, wherein said at least one aperture in said label ply has a diameter smaller than the diameter of said at least one aperture in said body ply.

2. A tubular container as defined in claim 1 wherein said liner ply is substantially transparent.

3. A tubular container as defined in claim 1 wherein said liner ply is adhered to the inner surface of said body ply with a wet adhesive.

4. A tubular container as defined in claim 1 wherein said liner ply is adhered to the inner surface of said body ply with a heat-activatible polymeric adhesive.

5. A tubular container as defined in claim 1 wherein said liner ply further comprises a polymeric moisture barrier layer.

6. A tubular container as defined in claim 5 wherein said moisture barrier layer includes polyolefin polymer.

7. A tubular container as defined in claim 5 wherein said moisture barrier layer includes at least one of the group of polyester, nylon, ethylene vinyl alcohol copolymer and blends thereof.

8. A tubular container as defined in claim 1 wherein said liner ply has a thickness of less than about three mils.

9. A tubular container as defined in claim 1 wherein said body ply and said liner ply are helically wound.

10. A tubular container as defined in claim 1 wherein said body ply and said liner ply are longitudinally wound.

11. A tubular container as defined in claim 1 wherein said body ply and said liner ply are rolled outwardly at an end of the tubular container to form a bead, and wherein said liner layer is elastically deformable and prevents said bead from unrolling.

12. A multi-ply tubular container having a window for viewing the product contained therein comprising:

at least one body ply formed of a fibrous paperboard, said body ply being wrapped into a tubular shape having an inner surface and an outer surface, said body ply defining at least one aperture therethrough such that said aperture forms a window into the container;

a liner ply adhered to the inner surface of said body ply and having a portion extending across said aperture, said liner ply comprised of a polymeric material having a low opacity which allows the product in the container to be viewed through the window and;

a label ply adhered to the outer surface of said body ply and defining at least one aperture therethrough corresponding to said at least one aperture in said body ply, wherein said at least one aperture in said label ply defines a marginal edge portion overlaying the edge of said at least one aperture in said body ply.

13. A tubular container as defined in claim 12 wherein said liner ply is substantially transparent.

14. A tubular container as defined in claim 12 wherein said liner ply is adhered to the inner surface of said body ply with a wet adhesive.

15. A tubular container as defined in claim 12 wherein said liner ply is adhered to the inner surface of said body ply with a heat-activatible polymeric adhesive.

16. A tubular container as defined in claim 12 wherein said liner ply further comprises a polymeric moisture barrier layer.

17. A tubular container as defined in claim 16 wherein said moisture barrier layer includes polyolefin polymer.

18. A tubular container as defined in claim 16 wherein said moisture barrier layer includes at least one of the group of polyester, nylon, ethylene vinyl alcohol copolymer and blends thereof.

19. A tubular container as defined in claim 12 wherein said liner ply has a thickness of less than about three mils.

20. A tubular container as defined in claim 12 wherein said body ply and said liner ply are helically wound.

21. A tubular container as defined in claim 12 wherein said body ply and said liner ply are longitudinally wound.

22. A tubular container as defined in claim 12 wherein said body ply and said liner ply are rolled outwardly at an end of the tubular container to form a bead, and wherein said liner layer is elastically deformable and prevents said bead from unrolling.

23. A multi-ply tubular container having a window for viewing the product contained therein comprising:

at least one body ply formed of a fibrous paperboard, said body ply being wrapped into a tubular shape having an inner surface and an outer surface, said body ply defining at least one aperture therethrough such that said aperture forms a window into the container;

a liner ply adhered to the inner surface of said body ply and having a portion extending across said aperture, said liner ply conprised of a polymeric material having a low opacity which allows the product in the container to be viewed through the window; and a label ply adhered to the outer surface of said body ply and defining at least one aperture therethrough corresponding to said at least one aperture in said body ply, wherein said label ply has at least one locating device to facilitate alignment during assembly of said corresponding apertures in said at least one body ply and said label ply.

24. A tubular container as defined in claim 23 wherein said liner ply is substantially transparent.

25. A tubular container as defined in claim 23 wherein said liner ply is adhered to the inner surface of said body ply with a wet adhesive.

26. A tubular container as defined in claim 23 wherein said liner ply is adhered to the inner surface of said body ply with a heat-activatible polymeric adhesive.

27. A tubular container as defined in claim 23 wherein said liner ply further comprises a polymeric moisture barrier layer.

28. A tubular container as defined in claim 27 wherein said moisture barrier layer includes polyolefin polymer.

29. A tubular container as defined in claim 27 wherein said moisture barrier layer includes at least one of the group of polyester, nylon, ethylene vinyl alcohol copolymer and blends thereof.

30. A tubular container as defined in claim 23 wherein said liner ply has a thickness of less than about three mils.

31. A tubular container as defined in claim 23 wherein said body ply and said liner ply are helically wound.

32. A tubular container as defined in claim 23 wherein said body ply and said liner ply are longitudinally wound.

33. A tubular container as defined in claim 23 wherein said body ply and said liner ply are rolled outwardly at an end of the tubular container to form a bead, and wherein said liner layer is elastically deformable and prevents said bead from unrolling.

34. A tubular container as defined in claim 23 wherein said at least one locating device comprises at least one of an optically readable eye mark and a magnetically readable eye mark.

* * * * *